United States Patent [19]

Koella, III

[11] 4,208,865

[45] Jun. 24, 1980

[54] METHOD AND MEANS FOR CLEARING YARN UNDERWINDINGS FROM TEXTILE SPINDLE ASSEMBLIES

[75] Inventor: Ernest Koella, III, Rockford, Tenn.

[73] Assignee: Zinser Textilmaschinen GmbH, Ebersbach/Fils, Fed. Rep. of Germany

[21] Appl. No.: 930,551

[22] Filed: Aug. 3, 1978

[51] Int. Cl.[2] ..... D01H 9/16

[52] U.S. Cl. ..... 57/303; 57/306

[58] Field of Search ..... 57/34.5, 34 TT, 54, 57/56, 156, 300, 303–306

[56] References Cited

U.S. PATENT DOCUMENTS

| | | | |
|---|---|---|---|
| 2,932,149 | 4/1960 | Ingham, Jr. | 57/34 TT X |
| 3,263,407 | 8/1966 | Jones, Sr. | 57/56 X |
| 3,312,051 | 4/1967 | Schumann et al. | 57/56 X |
| 3,426,518 | 2/1969 | Winter et al. | 57/56 X |
| 3,631,663 | 1/1972 | Krauss et al. | 57/34.5 X |
| 3,782,094 | 1/1974 | Flowers et al. | 57/54 X |
| 4,094,134 | 6/1978 | Kazuo | 57/34.5 X |
| 4,133,168 | 1/1979 | Keller, Jr. et al. | 57/305 X |

FOREIGN PATENT DOCUMENTS

| | | | |
|---|---|---|---|
| 575385 | 10/1977 | U.S.S.R. | 57/303 |

*Primary Examiner*—John Petrakes
*Attorney, Agent, or Firm*—Joseph H. Heard

[57] ABSTRACT

Independently actuable underwinding clearers are mounted adjacent to those lower portions of the machine's spindle assemblies upon which yarn underwindings are placed preparatory to the formation of yarn packages upon the upper portions of the spindle assemblies. Upon actuation thereof during each cycle of package building operation of the textile machine, the clearers separate the lengths of yarn interconnecting the underwindings with the yarn packages undergoing formation upon the spindle assemblies. The clearers preferably are actuated sequentially and pneumatically. A preferred mode of actuation of the clearers is by blasts of air emitted from a mobile servicing apparatus, such as a conventional pneumatic traveling cleaner, during movement of the apparatus along the length of the textile machine.

24 Claims, 12 Drawing Figures

METHOD AND MEANS FOR CLEARING YARN UNDERWINDINGS FROM TEXTILE SPINDLE ASSEMBLIES

BACKGROUND OF THE INVENTION

This invention relates to textile spinning frames or similar machines having spindle assemblies upon whose lower portions yarn underwindings are formed preparatory to the formation of yarn packages upon the upper portions of the assemblies. The invention more specifically relates to an improved method and means for effecting clearance or removal of the yarn underwindings from the lower portions of the spindle assemblies once the underwindings have performed their intended function.

As employed herein, the term "yarn" is intended to encompass all manner of textile strands, whether formed of fibers, filaments or combinations thereof.

In accordance with a well-known mode of operation of a textile spinning frame or like machine, a plurality (e.g., three to five) of wraps or "underwindings" of yarn are formed about the lower portion of each spindle assembly of the machine upon completion of each cycle of package building operation of the machine. The underwindings serve to maintain continuous yarn "thread-lines" to the spindle assemblies while the completed yarn packages are doffed from the assemblies' upper portions and empty bobbins or the like are donned thereon. Upon start-up of the machine, then ensuing upward movement of its ring rails and resumed rotation of its spindle assemblies upwardly displaces the yarn "thread-lines" from the underwound lower portions of the assemblies, and thus the formation of new yarn packages upon the upper portions of the assemblies is automatically initiated. After the foregoing has occurred, the yarn underwindings upon the assemblies are superfluous. However, at each spindle assembly a length of yarn continues to interconnect the yarn underwindings upon its lower portion and the yarn package undergoing formation upon the upper portion of the assembly. Unless somehow earlier removed, such underwindings will therefore remain upon the lower portions of the spindle assemblies throughout the then transpiring package-building operation of the textile machine, and also during the following period when a new series of yarn underwindings are formed upon the lower portions of the spindle assemblies. This and each subsequent series of yarn underwindings overlies and thus secures in place the underwindings already present upon the lower portions of the spindle assemblies. Accumulations of underwindings therefore tend to "grow" upon the spindle assemblies. Since accumulations of excessive size will in various ways impede the operation of the textile machine, "clearance" or removal of the underwindings from the lower portions of the spindle assemblies must eventually be effected in some manner.

One known way of achieving the foregoing result is by a machine operator periodically manually applying an abrading tool, such as a rasp or stiff wire brush, to the yarn underwindings upon the lower portion of each rotating spindle assembly of the textile machines for which such operator is responsible. This procedure is hazardous, tedious and time-consuming, as a consequence of which it may be readily "overlooked" by an operator and, even if actually performed, is expensive from the viewpoint of labor cost. Additionally, the application of abrading forces so shreads or disintegrates the yarn underwindings as to create large quantities of undesirable air-borne fibers or "fly", and will in time also mar or otherwise adversely affect the surfaces of the lower portions of the spindle assemblies.

Another manual technique sometimes employed is for an operator to cut away the accumulated underwindings, by the use of a knife or other cutting tool, upon the lower portions of the spindle assemblies. This procedure is also tedious and time consuming and, moreover, can be safely performed only when the textile machines are not operating. It is therefore expensive from the viewpoint of lost production time, as well as from the labor cost viewpoint.

In recognition of the deficiencies of purely-manual techniques, various automated or semi-automated mechanisms have heretofore been proposed for removing or assisting in the removal of yarn underwindings from the spindle assemblies of textile machines of the types in question. Illustrative prior-art mechanisms are disclosed in U.S. Pat. Nos. 3,782,094, 3,631,663, 3,539,714, 3,426,518, 3,339,356, 3,312,051, 3,263,407 and 2,932,149. Of the foregoing prior-art patents, U.S. Pat. No. 2,932,149 is particularly noteworthy. Such patent discloses a mechanism actuable during each package-building cycle of operation of a textile machine for effecting separation of the length of yarn extending from the single series of yarn underwindings (referred to as "curls" in the patent) then present upon the lower portion of each spindle assembly of the machine, and interconnecting such underwindings with the yarn package then undergoing formation upon the assembly's upper portion. The patent correctly states that after the foregoing length of innerconnecting yarn is separated, the yarn underwindings upon the lower portion of each spindle assembly will usually be automatically cast-off the assembly under the impetus of the latter's continued rotation and the wind-resistance upon the then free "tail" of the underwindings. The aforesaid mode of effecting removal of the yarn underwindings does not necessitate the application of abrading forces to either the spindle assemblies or to the yarn underwindings thereon. It therefore does not damage the spindle assemblies and also, when performed in an optimum manner, permits ready waste-collection of the cast-off underwindings in virtually intact and unentangled condition.

While the mechanism of U.S. Pat. No. 2,932,149 is superior to many other underwinding clearers of the prior art, the yarn separating components which it employs are so constructed and positioned that the underwindings could readily become entangled thereon or cut into smaller lengths while being cast-off from the rotating spindle assemblies. Additionally, the mechanism does not readily lend itself to rapid and low-cost installation, particularly on a "retrofit" basis, to spinning frames or similar textile machines of differing designs and constructions. The mechanism also apparently effects separation of the interconnecting lengths of yarn substantially simultaneously at all of the many spindle assemblies of the textile machine upon which it is installed. Simultaneous separation of the interconnecting lengths of yarn may be effected without detrimental consequences under certain conditions, such as when the yarn undergoing processing is of a relatively "weak" construction. However, when the yarn undergoing processing is relatively strong, as by reason of its size, twist and/or fibrous composition, the attempted simultaneous separation of the interconnecting yarn lengths at each of the many spindle assemblies of the textile machine imposes a significant drag force or additional load upon the whirl-belt drive mechanism customarily employed in a textile machine of the type in question to impart rotative movement to its spindle assemblies. This in turn may cause a significant reduction in the speed of rotation at which the spindle assemblies are driven. Such result is particularly likely to ensue when the drive mechanism is of the type employing a so-called "tangential" belt drive and when yarn separation is achieved by a breaking rather than a cutting action. In any case it is highly undesirable since reduction in the speed of spindle rotation causes the yarn then undergoing processing to receive a lesser degree of twist, and thus to be of inferior quality.

Other prior patents of possible relevence to the present invention, although not pertaining to clearance of yarn underwindings from textile spindle assemblies, include the following: U.S. Pat. Nos. 3,429,745, 3,498,039, 3,540,200, 3,626,680, 3,638,412, 3,651,628, 3,672,143, 3,673,780, 3,712,040, 3,726,072, 3,728,852 and 3,899,868.

SUMMARY OF THE INVENTION

The present invention provides an improved method and means by which the clearance of yarn underwindings, from the spindle assemblies of a textile machine of the type in question, can be and is effected reliably, economically, safely, with minimum "fly" generation, and with no adverse effects whatsoever upon the structure or operation of the textile machine.

In one aspect thereof, the present invention provides improved underwinding clearers of the type which are mounted upon a textile machine in an adjacent relationship to the machine's spindle assemblies, and which when actuated effect separation of the lengths of yarn interconnecting the underwindings upon the lower portions of the spindle assemblies with the yarn packages undergoing formation upon the upper portions of the assemblies. The improved clearers of the invention are particularly, but not necessarily exclusively, adapted for pneumatic and sequential actuation.

In accordance with other aspects thereof, the present invention provides methods and means for sequentially and/or pneumatically actuating underwinding clearers mounted upon and along the length of a textile machine in adjacent relationship to the spindle assemblies of the machine.

In a preferred specific embodiment of the invention, underwinding clearers mounted as aforesaid along the length of an elongated textile machine are sequentially and pneumatically actuated by blasts of air emitted from a mobile servicing apparatus, such as a conventional traveling pneumatic cleaner, during movement of the apparatus along the length of the textile machine.

DESCRIPTION OF THE DRAWINGS

Other features and aspects of the invention will be apparent from the following description of preferred and alternative embodiments thereof, which should be read in conjunction with the accompanying drawings, in which.

DESCRIPTION OF THE ILLUSTRATIVE EMBODIMENTS

Figure 1:
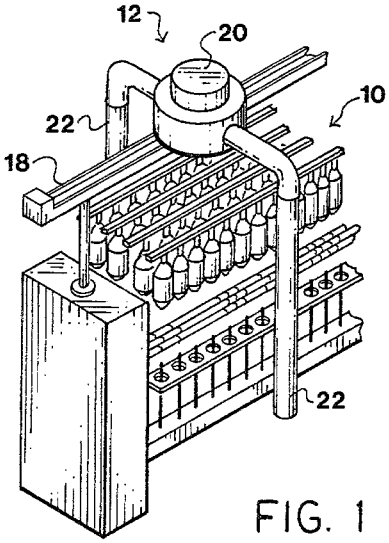
FIG. 1 is a partially schematic, fragmentary perspective view of a textile spinning frame or similar machine having spindle assemblies from which yarn underwindings are adapted to be removed in accordance with the method and means of the present invention, there also being shown in association with the machine a mobile servicing apparatus in the form of a known type of traveling pneumatic cleaner.
Figure 3:
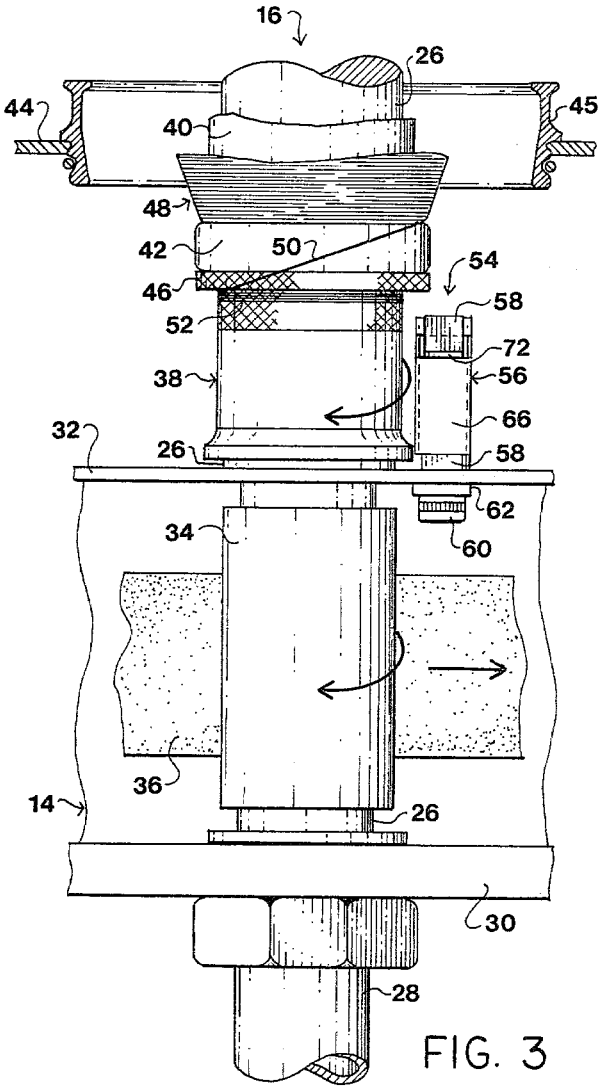
FIG. 3 is an enlarged, fragmentary front elevational view of part of one of the spindle assemblies and some adjacent conventional components of the textile machine of FIG. 1, and of an associated underwinding clearer in accordance with the invention.
Figure 6:
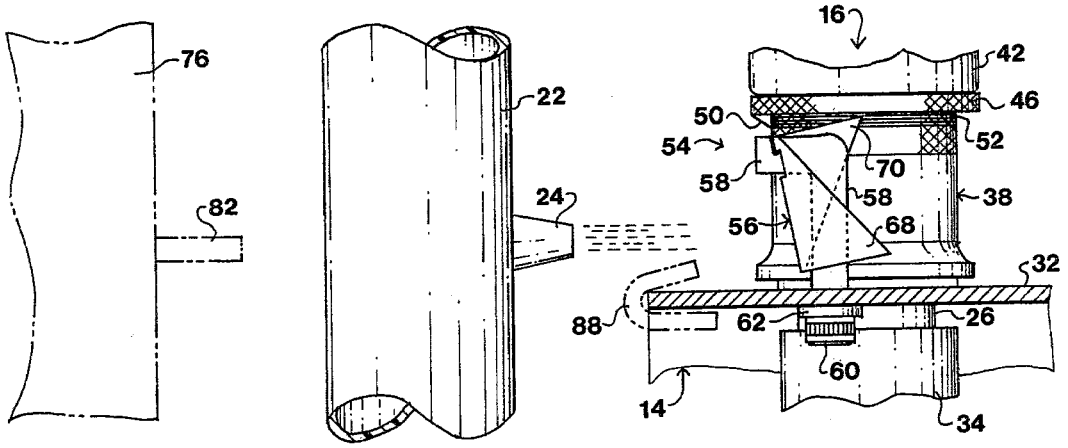
FIG. 6 is a side elevational view similar to FIG. 4, but showing the underwinding clearer undergoing actuation by pneumatic means.

FIG. 1 of the drawings shows an elongate textile machine 10 and associated mobile servicing apparatus 12. Machine 10 may be and illustratively is a textile spinning frame having, at each side thereof and in addition to other conventional components, an elongate spindle rail along the length of which are mounted a plurality of upright spindle assemblies. Fragmentary portions of one spindle rail and one spindle assembly of machine 10 are also shown in FIG. 3, and are there respectively designated by the numerals 14,16. The mobile servicing apparatus 12 shown in FIG. 1 is a conventional traveling pneumatic cleaner having a main body portion which is mounted for self-propelled reciprocatory movement along a suitable overhead track or rail 18 extending in overlying relationship to machine 10 along substantially its entire length. A blower or impeller unit 20 associated with the main body portion of apparatus 12 communicates with the upper end portions of elongate flexible conduits 22 which depend downwardly adjacent opposite sides of spinning machine 10. A plurality of inwardly-facing nozzle-like openings 24, one of which is shown in FIG. 6, are spaced vertically from each other along the length of each conduit 22. As apparatus 12 patrols to and fro along the length of spinning machine 10, as it normally does at frequent intervals during the regular operation of the spinning machine, blasts of air are discharged from nozzles against those portions of machine 10 in adjacent relationship to which the nozzles pass. Traveling cleaners of the aforesaid general type are well known to those skilled in the art and have long been in general use in textile mills. Among the manufacturers of such cleaners are Parks-Cramer Company, of Fitchburg, Massachusetts; and the Bahnson Company, a Winston-Salem, North Carolina division of Envirotech Corporation. Pneumatic cleaners of the general type in question are disclosed in various prior patents: See, e.g., U.S. Pat. No. 3,429,745.

The spindle assembly 16 shown in FIG. 3 is also of a conventional construction. The assembly includes an upright spindle blade 26 which is mounted for rotative movement about its axis by a bolster 28 affixed to a horizontally extending bottom flange member 30 of spindle rail 14 of machine 10; and which extends upwardly from bolster 28 through and beyond a top flange and/or cover member 32 of rail 14. Rotation is imparted to spindle blade 26, during operation of machine 10, by a whirl 34 which is connected to or formed integrally with that portion of the blade disposed inermediate rail members 30,32 and which is driveably engaged by a drive belt 36 of machine 10. Although no restriction to such arrangement is intended or should be made, the illustrative driving connection is of the so-called "tangential" type and imparts clockwise or "Z-twist" rotation to spindle blade 26. The section of blade 26 above spindle rail 14 includes an integral lower portion 38 of spool-like shape, and an elongate upper portion (only a fragmentary part of which is shown in FIG. 3) which receives and driveably engages a tubular bobbin member 40 (also only fragmentarily shown) illustratively having a metal ferrule 42 at its lower end. Some of the circumferential surfaces of spindle portion 38 may be and customarily are knurled, as shown in the drawings.

FIG. 3 also shows in vertical section a fragmentary portion of one of the vertically-movable ring rails 44 of machine 10, and the one of the machine's spinning rings 45 which is mounted upon such rail in encircling relationship to the illustrated spindle assembly 16. As is well known to those skilled in the art, yarn from the drafting rolls (not shown in FIG. 3) of machine 10 passes through a traveler (not shown) rotatable about ring 44, and thence to spindle assembly 16. During regular packagebuilding operation of machine 10, the aforesaid yarn is wound upon the bobbin then mounted upon the upper portion of spindle assembly 16. When a complete yarn package has been formed, which usually requires a period of some two to six hours, a plurality (usually, e.g., 3–5) of yarn wraps or underwindings are wound about that part of spool-like portion 38 of each assembly 16 immediately beneath the top collar-like flange 46 of spindle portion 38. This is achieved by lowering ring rails 44 of machine 10 to appropriate depressed elevations. Rotation of all spindle assemblies 16 of machine 10 is then halted. Assemblies 16 remain stationary while the complete yarn packages are removed or "doffed" therefrom, and empty bobbins 40 are placed or "donned" thereon. Upon the next-ensuing start-up of machine 10, its ring rails 44 move upwardly and its spindle assemblies 16 again undergo rotation, thus initiating the formation of new yarn packages upon each of the spindle assemblies 16 of machine 10. The new yarn package undergoing formation upon the spindle assembly 16 shown in FIG. 3 is designated by the numeral 48. As is indicated in FIG. 3, the yarn package 48 upon the upper portion of each spindle assembly 16 is connected by a length of yarn 50 to the yarn wraps or underwindings 52 previously wound upon spool-like portion 38 of assembly 16. The length of innerconnecting yarn 50 extends (see also FIG. 4) angularly upwardly and outwardly from the periphery of the main body of spindle portion 38, across the peripheral cylindrical surfaces of collar-like flange 46 and ferrule 42 of spindle portion 38 and bobbin 40, respectively, and thence into the interior of yarn package 48.

Once the formation of a new yarn package upon each spindle assembly 16 has been successfully commenced, as described above, the underwindings 52 upon each spindle portion 38 are superfluous and should be removed. Unless they are removed prior to the next "doff" of machine 10, underwindings 52 will be overlaid by the next series of yarn underwindings then formed upon spindle portion 38. The second series of overlying underwindings (not shown in the drawings) would then secure the first series of underwindings 52 in place upon spindle portion 38, notwithstanding breakage of the innerconnecting length of yarn 50 during doffing of yarn package 48 from assembly 16. Repetition of the foregoing sequence of events would inevitably produce in due course a sizeable accumulation of successively-overlaid yarn underwindings upon each spindle portion 38. Such accumulated underwindings are undesirable since, firstly, they may and likely will impede the breakage which is supposed to occur, during each doffing of complete yarn packages from spindle assemblies 16 of machine 10, of the yarns (not shown in the drawings) extending between such full packages and the spindle assemblies. Secondly, it is quite difficult to effect removal of large accumulations of yarn underwindings from the spindle assemblies of a textile machine, particularly if the machine is to remain in operation which such removal is effected and the generation of large quantities of undesirable "fly" is to be avoided.

The foregoing and other problems inherent in allowing accumulations of yarn underwindings to form upon spindle assemblies of machine 10 can be obviated by effecting clearance or removal of each series of the underwindings 52 from each of the spindle assemblies 16 of machine 10 while the yarn package 48 to which such series of underwindings 52 is connected is still undergoing formation. This result may be most advantageously effected by separating, during the aforesaid time interval of yarn package formation, the length of yarn 50 innerconnecting the underwindings 52 and yarn package 48 upon each spindle assembly 16. Upon separation of the aforesaid innerconnecting length of yarn 50, underwindings 52 are cast-off from spindle assembly 16, under the impetus of the assembly's continued rotation during the remainder of the package-building cycle of operation of machine 10, in a virtually intact condition. Little if any undesirable "fly" is generated.

Figure 7:
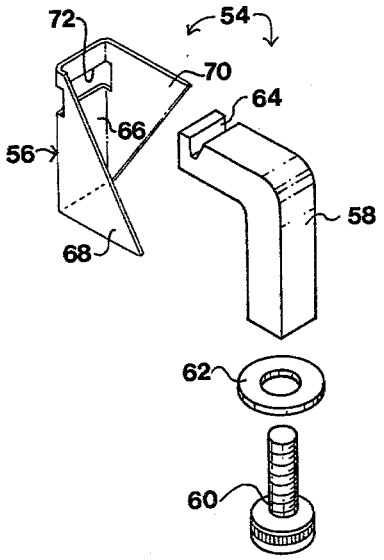
FIG. 7 is an enlarged exploded perspective view of the clearer shown in FIGS. 3–6.

The present invention provides, in one of its aspects, improved means for effecting clearance or removal in the above-described manner of the yarn underwindings from the spindle assemblies of machine 10. In one of its embodiments the improved clearer means comprises cleaner units, associated with respective ones of the spindle assemblies of machine 10, which may each be of the construction of the clearer 54 shown in FIGS. 3–6 in association with the illustrated spindle assembly 16. As shown in such figures, and also in FIG. 7, cleaner 54 includes a main body member 56, and mounting means in the form of a post-like member 58 of generally inverted L-shaped configuration. The longer leg of post 58 is fixedly secured at its lower end to the top flange or cover member 32 of spindle rail 14, as by means of a bolt 60 and washer 62, and projects vertically upwardly from rail 14 in laterally spaced adjacent relationship to portion 38 of spindle assembly 16. The shorter leg of post 58 projects generally horizontally forwardly, at an elevation spaced below that of the undersurface of collar-like flange 46 of spindle portion 38, and has a generally V-shaped notch 64 within that part of its upper surface adjacent its free forward end. Member 56 of clearer 54 may be and illustratively is formed, by simple stamping and bending operations, from a single piece of sheet metal. It includes a generally rectangular shaped main section 66, and opposing side sections 68,70 of generally right-triangular shapes. The side section 70 adjacent spindle portion 38 has its "hypotenuse" edge extending angularly upwardly from the bottom edge of main section 66, whereas the corresponding "hypotenuse" edge of the other side section 68 extends angularly downwardly from the top edge of section 66. A slotlike opening 72 is provided through the upper part of section 66 of member 56, as is best shown in FIG. 7 perspective view thereof. In the assembled condition of clearer 54, illustrated in FIGS. 3–6, the upper edge of slot 72 rests upon the base of the generally V-shaped notch 64 within the free forward end portion of post 58. This suspends member 56 for pivotal movement between inoperative and operative positions, respectively shown in FIGS. 4 and 6, about a generally horizontally extending axis defined by the engaging surfaces of the upper edge of slot 72 and the base of notch 64. Slot 72 is so dimensioned as to provide the necessary clearance between its other edges and the thereto adjacent surfaces of post 58 for pivotal movement of member 56 to occur freely and without "binding". On the other hand, the aforesaid clearance is sufficiently small to discourage member 56 from assuming a "skewed" orientation upon post 58, or its becoming accidentally disengaged from the post, during such pivotal movement.

Figure 4:
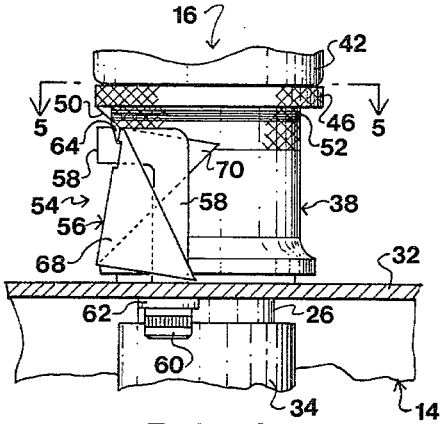
FIG. 4 is a side elevational view of the underwinding clearer of FIG. 3, and of some of the textile machine components adjacent thereto.
Figure 5:
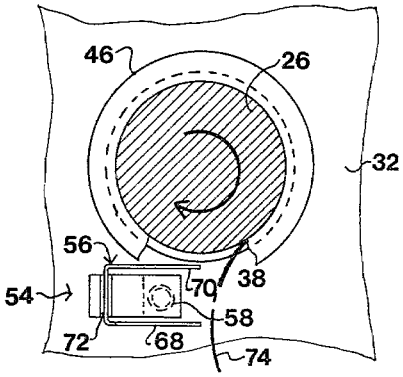
FIG. 5 is a view taken substantially along the line 5—5 of FIG. 4, showing the clearer in top plan, and showing adjacent components of the textile machine, some of which have been partially broken away for clarity, in top plan and horizontal section.

Its center of gravity is so disposed relative to the upper edge of slot 72 that member 56 is biased by gravity to its normally-occupied inoperative position shown in FIGS. 3–5. The pointed free end of side section 68, which in effect constitutes stop means limiting pivotal movement of member 56 in one direction, then engages the underlying upper surface of member 32 of spindle rail 14. The pointed free end portion of opposite side section 70 of member 56 vertically underlies collar-like flange 46 of spindle portion 38, but in the inoperative position (FIGS. 3–5) of member 56 is inclined downwardly and spaced vertically from the undersurface of flange 46. In the latter connection, the vertical clearance between the undersurface of flange 46 and clearer 54 is such that neither post 58 nor the inoperatively-positioned member 56 impede the formation, at the end of each package-building cycle of operation of machine 10, of yarn underwindings 52 upon the upper part of the main body of spindle portion 38. It will also be apparent from FIG. 3 that clearer 54 will not impede movement of ring rail 44 and spinning ring 45 to the depressed positions (not shown in the drawings) which such components occupy during formation of underwindings 52: At such time clearer 54 is received freely within spinning ring 45 and does not engage either the ring or the traveler (not shown) carried by it.

Upon each actuation of clearer 54, which actuation is achieved in a manner subsequently described, member 56 pivots from its operative position of FIGS. 3–5 to its operative position of FIG. 6, such pivotal movement being in a counterclockwise direction as viewed in FIGS. 4 and 6. The pointed free end portion of side section 70 of member 56 constitutes yarn separating means which, in the FIG. 6 operative position of member 56, intersects the path of rotary travel, about the axis of the rotating spindle assembly 16, of a segment of the length of yarn 50 innerconnecting yarn underwindings 52 and the yarn package 48 undergoing formation upon assembly 16. More specifically and in the particular illustrative embodiment of spindle and clearer components shown in FIG. 6, the pointed free end portion of section 70 of member 56 projects closely adjacent the undersurface of flange 46 of spindle portion 38. at a location intermediate the width or radial dimension of flange 46, so as to opposingly intersect the path of rotary travel of that particular free segment of the innerconnecting yarn 50 which extends angularly upwardly from the main body of spindle portion 38 to the peripheral circumferential surface of flange 46. When rotary movement of spindle assembly 16 brings the aforesaid segment of yarn 50 into engagement with the upwardly projecting free end portion of section 70, the force of such engagement will of course tend to pivot member 56 further in a counterclockwise direction, beyond its operative position of FIG. 6. However, such further counterclockwise pivotal movement of member 56 is prohibited by engagement of the pointed free end portion of section 70 with the undersurface of flange 46, and/or by engagement of the bottom edge of section 56 of member 56 with the forward surface of the vertical leg of post 58 of clearer 54. Allowing the pointed free end of section 70 of member 54 to actually engage the undersurface of collar 46, and thus itself prohibit counterclockwise pivotal movement of member 54 beyond its operative position, is an acceptable practice when (as in the illustrated construction) spindle assembly 16 possesses a flange 46 having a smooth undersurface. Such procedure would not be satisfactory, however, if flange 66 had a knurled or otherwise irregular undersurface, or if the particular spindle assembly with which clearer 54 was associated totally lacked a component comparable to flange 56 for the free end of section 70 of member 56 to engage: An illustrative spindle assembly of such type is disclosed, e.g., in U.S. Pat. No. 2,932,149. In the foregoing and analogous situations another type of stop means, such as that previously described and including the bottom edge of section 66 of member 56, may if needed be employed to prohibit pivotal movement of member 56 beyond its operative position.

Irrespective of the particular type of stop means employed in association with member 56, the free end portion of its section 70 will constitute an impassable barrier to the segment of the yarn 50 brought into engagement therewith by rotation of spindle assembly 16, and therefore will effect separation of such yarn. Preferably the yarn separation is accomplished by attentuation-breakage, rather than by cutting. While the upper part of the "hypotenuse" edge of side section 70 of member 54 might be sharpened, so as to subject the yarn engaging it to a cutting action, this is not required and would add significantly to the costs of manufacture and maintenance of clearer 54. Additionally, it is believed that separation of the yarn by attenuation, as occurs when the aforesaid edge of member 54 is relatively blunt, assists in minimizing "fly" generation. In the latter connection it will be appreciated that separation of the length of yarn 50 leaves first and second "tails" thereof respectively connected to package 48 and underwindings 52. These yarn tails tend to disintegrate into "fly" under the impetus of the centrifugal and/or other forces imposed thereon during their rotation about the axis of spindle assembly 16. Separation of yarn 50 by attenuation, rather than by cutting, is believed to produce tails which are more tightly compressed and which therefore better withstand the disintegrating forces imposed thereon. This capability is particularly desirable in the case of the yarn-package tail (not shown in the drawings), since it remains in association with spindle assembly 16 until package 48 has been completely formed and doffed from machine 10.

The other tail produced by separation of yarn length 50, i.e., the one connected to underwindings 52, is indicated in FIG. 5 by phantom lines and the numeral 74. Promptly after yarn length 50 is separated and tail 74 is formed, the engagement of underwindings 52 with spindle portion 38 begins to loosen, and tail 74 begins to lengthen due to its tendency to "lag behind" the continued rotative movement of spindle assembly 16. The rotating tail 74 may engage clearer 54, even though after each actuation thereof member 56 promptly returns by gravity to its inoperative position, since the loosened underwindings 52 at times tend to slip downwardly upon spindle portion 38. However, such engagement does not create any appreciable "fly" since clearer 54 preferably and illustratively has no sharp edges upon which tail 74 might be cut into undesirable small lengths, and also since underwindings 52 are usually cast-off entirely from the rotating spindle assembly 16 within a brief time interval following separation of yarn length 50. In most instances the cast-off underwindings 52 are therefore in a virtually intact condition, as opposed to being shredded or fly-like.

While actuation thereof in various other ways is possible, clearer 54 is adapted to be and preferably is pneumatically actuated by air blasts emitted from a mobile servicing apparatus associated with and movable longitudinally of textile machine 10. The use of a traveling pneumatic cleaner, such as that designated in FIG. 1 by the numeral 12 and previously described, is particularly preferred for the foregoing purpose since servicing apparatuses of such type are present in most textile mills and are capable of performing the present clearer-actuating function with no (or, at most, only minor) structural modification. In the latter regard, all that is required is that each of the elongate conduits 22 of pneumatic cleaner 12 have one of its vertically-spaced nozzles disposed, as in the case of the nozzle 26 shown in FIG. 6, so as to discharge air blasts upon the upper part of the spindle-rail area of machine 10. The blasts of air continously discharged from the nozzle 26 illustrated in FIG. 6 impinge upon clearer 54 as conduit 22 passes, during the patrolling reciprocatory movement of cleaner 12 longitudinally of machine 10, the longitudinal section of spindle rail 14 upon which spindle assembly 16 and clearer 54 are mounted. The force of each such air blast is received primarily by the forward face of section 66 of member 56 of clearer 54. Such face of section 66 extends generally transversly to the direction of the blast, and has a relatively large surface area of which all but an insignificant part is located below the upper edge of the slot 72 about which member 56 pivots. It in effect constitutes "sail" or vane-like actuator means which, in response to the impingement of an air blast thereon, causes member 56 to promptly pivot from its inoperative (FIGS. 3–5) position to its operative (FIG. 6) position. Member 56 remains in the latter position only until it is no longer subjected to the blasts of air emanating from nozzle 26 due to the continued movement of traveling cleaner 12 along the length of machine 10. At the customary rates of travel of pneumatic cleaning apparatuses, the time required for passage of cleaner 12 beyond clearer 54 will not be large. However, in view of the high speed of rotation of spindle assembly 16, actuation of clearer 54 for even only a very brief time interval is usually sufficient for the yarn separating means of clearer 54 to perform its yarn-separating function. If for any reason this should not occur during the first passage of cleaner 12 by clearer 54, there will in any event be adequate opportunities for further attempts since cleaner 12 normally would pass many times along the entire length of machine 10 during each cycle of package-building operation of the machine.

As previously noted, additional clearers 54 are provided in association with the additional spindle assemblies 16 of machine 10 on both sides thereof. Each additional clearer 54 is momentarily actuated, in the same manner as previously described, as pneumatic clearer 12 passes into proximity therewith during its movement along the length of machine 10. Bearing in mind that the cleaner 12 has conduits 22 disposed on both sides of machine 10, and the possibility that nozzles 24 could be of varying lateral dimensions, the blasts of air emitted from nozzles 24 at any given location of cleaner 12 longitudinally of machine 10 might simultaneously actuite a limited number of the clearer members 54 adjacent such location. However, it will be appreciated that the basic mode of actuation of the clearers 54 along the considerable length of machine 10 is sequential, rather than simultaneous. Sequential rather than simultaneous actuation of the clearers 54 along the length of machine 10 is particularly desirable when high-strength yarn is being processed. If all of the clearers 54 were actuated simultaneously, the cumulative "drag" forces imposed upon the spindle drive means of machine 10, as the lengths of interconnecting yarn 50 at each of the spindle assemblies 16 were separated, could so reduce the speed of rotation of spindle assemblies 16 as to impair the quality of the yarn then being passing to and being wound upon the upper portions of such assemblies. When clearers 54 are actuated sequentially, the possibility of the foregoing undesirable result occurring is obviated.

Figure 2:
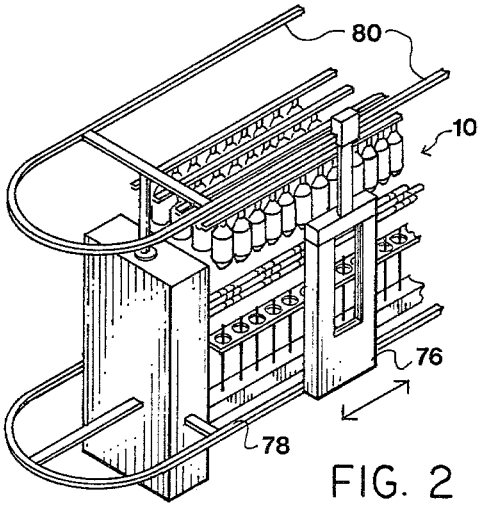
FIG. 2 is a perspective view similar to FIG. 1, but wherein the textile machine is serviced by an automatic piecing apparatus.

Mobile apparatuses of various other types may also be employed to sequentially actuate clearers 54. Increasing numbers of textile spinning machines are now also serviced by so-called yarn "piecing" apparatuses. Such apparatuses patrol the lengths of the spinning machine which they service, and detect and eliminate yarn discontinuities at those of the machine's spindle assemblies at which an "end-down" condition exists. Most if not all of such apparatuses employ pneumatic air-blast means in the performance of at least some of their servicing functions, and therefore have among their other drive and servicing components means for generating and/or storing a supply of compressed air. While piecing apparatuses of various types are well known to those skilled in the art, the apparatus 76 shown in FIG. 2 of the drawings for purposes of illustration is of the type manufactured and sold by Platt Saco Lowell Corporation (Easley, S.C.) under the trademark FILASOL. Apparatus 76 is mounted by a suitable track 78 and overhead rail 80 for self-propelled movement about machine 10 in closely adjacent relationship to each of the machine's spindle rails. As is indicated by the directional arrows in FIG. 2, apparatus 76 moves in both directions along its supporting track 78 and rail 80. However, it might be (and other piecing apparatuses are) so designed as to undergo unidirectional movement only. In keeping with the pneumatic traveling cleaner 12 previously described and shown in FIG. 1, the piecing apparatus 76 of FIG. 2 moves repeatedly past each of the spindle assemblies 16 of machine 10 during each cycle of package-building operation of the machine. In lieu of cleaner 12, piecing apparatus 76 may therefore be employed to sequentially and pneumatically actuate clearer members 54. Such alternative arrangement is indicated by phantom lines in the leftmost part of FIG. 6, wherein the numeral 82 designates a nozzlelike conduit which in accordance with the present invention is affixed to the frame of piecing apparatus 76, and suitably connected to the source of compressed air (not shown) carried by such apparatus, at an elevation such that blasts of air emitted from nozzle 82 will impinge upon successive ones of the clearers 54 during patrolling movement of apparatus 76 along the length of machine 10. As in the case of the blasts of air discharged from the nozzles 26 of traveling cleaner 12 (FIG. 1), nozzles 82 of piecing apparatus 76 may emit air continuously during movement of apparatus 76. Alternatively, however, a blast of air might be discharged from nozzle 82 of apparatus 76 only when the apparatus is so positioned longitudinally of machine 10 that the air will impinge upon one of the clearers 54. This mode of operation is possible since piecing apparatus 76 (in keeping with virtually all piecing apparatuses) includes means for ascertaining its position relative to each spindle assembly 16 of machine 10 during passage of the apparatus thereby. The foregoing data could therefore be readily employed, in association with suitable data-controlled valve means (not shown) intermediate nozzle 82 and the pressurized air source (not shown) carried by apparatus 76, to cause a blast of air to be discharged from nozzle 82 only when the nozzle is in a position of alignment with one of the clearers 54.

Pneumatic sequential actuation of clearers 54 can also be achieved in various other ways. One example is by a machine operator simply directing blasts of compressed air from a handheld air hose (not shown in the drawings) upon successive ones of the clearers as such operator strolls along the length of machine 10. While entailing some operator participation, actuation of clearers 54 in this manner could still be performed quite rapidly and, in view of the fact that both the operator and the air-hose in his grasp would be spaced from machine 10, without any possibility of operator injury. Clearers 54 might also be pneumatically and sequentially actuated by a "fixed" actuating system associated with machine 10. An illustrative system, diagramatically illustrated in FIG. 8, includes a main duct 84 extending substantially the full length of machine 10 and communicating at one end with a compressed air source 86. Communicating with duct 84 along the length thereof are a plurality of conduits 88, one of which is also shown in phantom lines in the right-hand portion of FIG. 6, each having its open outer end so positioned as to emit blasts of air against the "sail" or vane-like actuator part of member 56 of a therewith aligned one of the clearers members 54. As indicated in the top portion of FIG. 8, sequential actuation of clearer members 54 on an individual basis is achieved by the provision in association with each conduit 88 of solenoid-operated valves 90 which, during each cycle of package-building operation of machine 10, are sequentially and briefly opened by a "clock work" or other electrical sequential switching mechanism 92. A somewhat less expensive alternative arrangement is illustrated in the lower portion of FIG. 8, wherein the illustrated valves 90 controlled by switching mechanism 92 are associated with branch ducts 94 innerconnecting main duct 84 and manifolds 96. A small group of the conduits 88 communicate with each manifold 96, and air blasts are simultaneously emitted from all of the conduits 88 communicating with a particular manifold 96 when the valve 90 associated with such manifold is momentarily opened by switching mechanism 92. While this arrangement results in simultaneous actuation of limited numbers of the clearers 54, the overall and group-to-group mode of actuation of clearers 54 is sequential.

Figure 8:
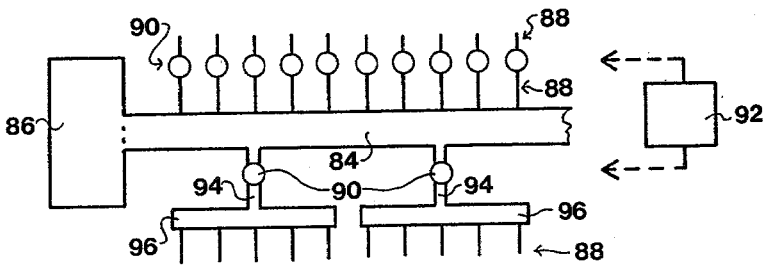
FIG. 8 is a schematic plan view of an alternative system for sequentially and pneumatically actuating the clearers of the invention.
Figure 9:
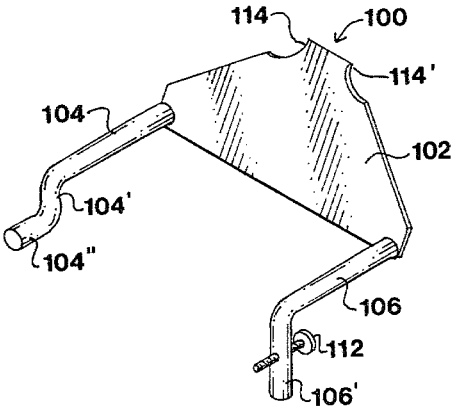
FIG. 9 is a rear perspective view of another embodiment of an underwinding clearer in accordance with the invention.

If an actuating system of the type shown in FIG. 8 were employed, the conduit 88 and clearer 54 associated with each spindle assembly 16 might of course occupy positions about the assembly's circumference other than the positions in which they shown, for convenience of illustration, in FIG. 6. The particular position of a clearer 54 about the circumference of the spindle assembly 16 with which it is associated may be varied in accordance with the location and nature of the particular means employed for clearer actuation.

Alternative embodiments are shown in FIGS. 9–12, wherein some components corresponding in substantial part to ones previously described are designated by the same reference numerals with the addition of a prime designation. The spindle assembly 16' of FIGS. 10–12 differs from the previously-described assembly 16 only in its additional inclusion of a disc-like member 98 disposed between spindle portion 38' and bobbin ferrule 42' and having a serrated peripheral edge extending radially outwardly beyond the aforesaid components. It is well known in the art to provide such a member 98, or even two superimposed ones of them, at such location. Since the yarn length 50' innerconnecting underwindings 52' and the yarn package undergoing formation upon spindle assembly 16' must pass over the serrated edge of disc-like member 98, a free segment of yarn 50' must be and is present beneath member 98 at a radial location inwardly of the serrations upon its peripheral edge and outwardly of the peripheral circumference of flange 46' of spindle portion 38'. The aforesaid free segment of yarn 50' might therefore be the one engaged and separated by the underwinding clearer of the present invention, in lieu of that lower free segment of the yarn disposed beneath flange 46'. The previously described clearer 54 (FIGS. 3–7) could be employed for this purpose simply by mounting the same upon spindle rail member 32' in a position slightly higher and slightly to the right of that position wherein clearer 54 is shown in FIG. 3. However, in FIGS. 9–12 there is shown a clearer unit 100, of alternative construction, for performing the aforesaid function.

Clearer 100 includes a main body member 102, in the form of an elongate flat plate disposed forwardly of spindle assembly 16' and extending generally in the length direction of spindle rail 14'; and mounting means in the form of two rod-like members 104,106. Members 104,106 are welded or otherwise rigidly secured at their forward ends to the rearward face of member 102, adjacent the opposite lower extremities thereof, and extend rearwardly therefrom in laterally-spaced "straddling" relationship to spindle assembly 16'. The rearward ends of members 104,106 have downturned portions 104',106' which respectively extend through bores 108,110 provided through spindle rail member 32 on opposite sides of spindle assembly 16'. Bores 108,110 are sufficiently larger in diameter than members 104,106 as to permit free pivotal movement of the latter relative to spindle rail member 32'. As illustratively shown in the drawings (see particularly FIG. 9), member 104 further includes a terminal free end portion 104'', which extends generally perpendicularly to downturned portion 104', and downturned portion 106' of member 106 includes a threaded bore adapted to receive a removable screw-like member 112. In the mounted (FIGS. 10–12) condition of cleaner 100, the foregoing components underlie spindle rail member 32 and serve to prevent possible inadvertent displacement of cleaner 100 therefrom. Portion 104'' of member 104 is by itself sufficient for the foregoing purpose: Screw-like member 112 constitutes an alternative construction and additionally may be employed to perform another function subsequently discussed.

Figure 10:
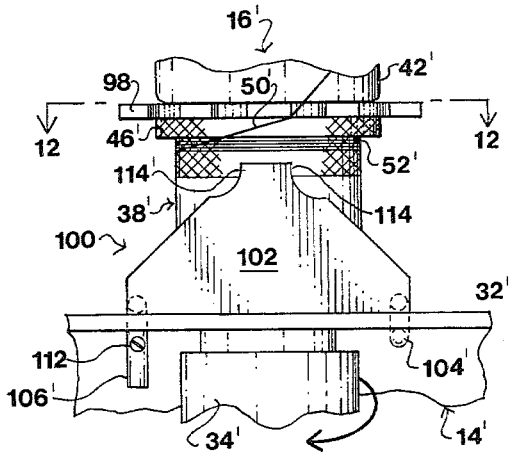
FIG. 10 is a front elevational view of the clearer of FIG. 9 mounted in association with a spindle assembly, only portions of which are shown, differing somewhat in construction from the spindle assembly of FIGS. 3–6.
Figure 11:
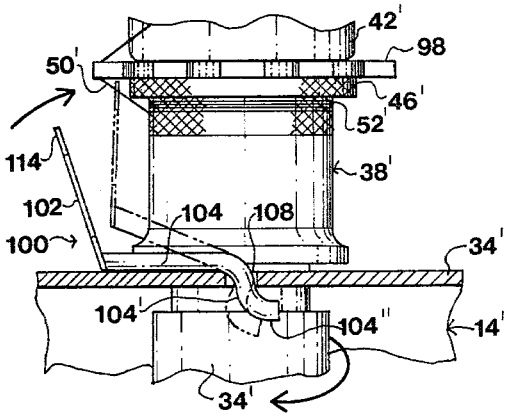
FIG. 11 is a side elevational view of the clearer and associated spindle components shown in FIG. 10.
Figure 12:
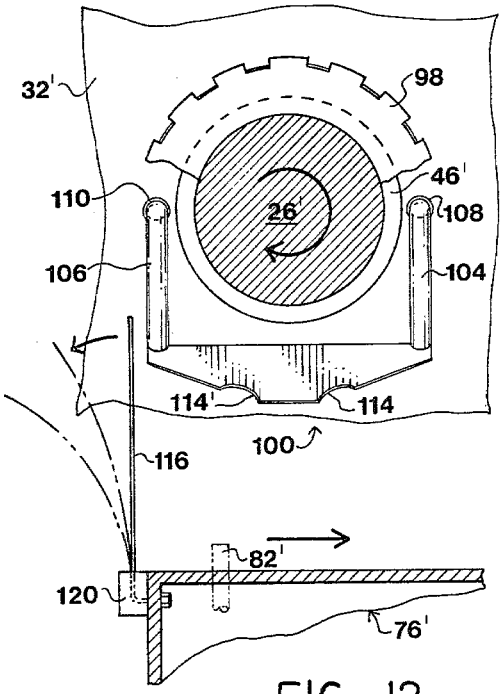
FIG. 12 is a view taken substantially along the line 12—12 of FIG. 10 and showing, partially in top plan and partially in horizontal section, the components of FIGS. 9–11 and fragmentary portions of means for actuating the underwinding clearer.

By reason of their above-described connection with spindle rail member 32, members 104,106 of clearer 100 mount main body member 102 thereof for pivotal movement about a generally horizontally-extending pivot axis between an inoperative position, shown in solid lines in FIGS. 10–12, and an operative position shown in phantom lines in FIG. 11. Movement of clearer 100 beyond its inoperative position, to which the clearer is biased by gravity, is stopped by then-transpiring engagement between the upper surface of spindle rail member 32 and the undersurfaces of member 102 and/or of the forward sections of member 104,106 of clearer 100. The forward angulation (of approximately 20° relative to the vertical) and upwardly-tapering shape of member 102 insure that the inoperatively positioned clearer 100 does not in any way impede the formation of underwindings 52' upon spindle portion 38' at desired times and in the same manner as previously described in connection with spindle assembly 16 (FIGS. 3–6). In the clearer's operative pivotal position shown in phantom lines in FIG. 11, yarn separating means in the form of a pointed upper edge portion 114 of member 102 projects closely adjacent the undersurface of disc-like member 98 of spindle assembly 16', at a radial location inwardly of the serrations of member 98, so as to intersect and effect separation of that free segment of the length of yarn 50' immediately below member 98 as rotation of spindle assembly 16' brings such yarn segment into engagement with portion 114 of member 102. The separation of yarn 50' results from attenuation-breakage thereof when, as is preferred, clearer 100 possesses no sharp edges. Following separation of yarn 50', underwindings 52 are of course "cast-off" from the rotating spindle assembly 16'.

Movement of member 102 beyond its operative (phantom-line) position may be halted by actual engagement of its upper edge with the undersurface of disc-like member 98. Alternatively, however, screw-like member 112 (FIGS. 9 & 10) may be employed to perform this stop-means function. By simply rotating screw 112 in the appropriate direction, its effective length may be readily adjusted so as to cause its head portion to engage the undersurface of spindle-rail member 38' when clearer 100 reaches any desired operative position, and thus to prohibit further pivotal movement of clearer 100 beyond such position.

In keeping with the clearer 54 of FIGS. 3–7, the clearer 100 of FIGS. 9–12 is particularly adapted for pneumatic actuation. The elongate forward face of member 102 of clearer 100 constitutes "sail" or vane-like actuator means which, in response to the impingement of air blasts thereon, causes pivotal movement of clearer 100 from its inoperative position (FIGS. 9–12, solid lines) to its operative position (FIG. 11, phantom lines). While any suitable air-blast producing means, including all of those discussed previously herein, might be employed for subjecting each clearer 100 to actuating blasts of air, the particular means illustratively shown (in part by phantom lines) in FIG. 12 comprises a nozzle 82' carried by a piecing apparatus 76' and corresponding to the nozzle 82 and apparatus 76 previously described herein. When movement of piecing apparatus 76' brings nozzle 82' into proximity with clearer 100, the latter is pivoted to its operative position by a blast of air emitted from nozzle 82' and impinging upon the "sail" or vane-like forward surface of member 102. When no longer subjected to an actuating blast of air, cleaner 100 promptly returns by gravity to its inoperative position.

While pneumatic actuation of the underwinding clearers is preferred, the same might be actuated in other ways. FIG. 12 also shows, by way of example in the foregoing regard, mechanical means for actuating clearer 100. Such actuating means includes a flexible and resilient wand-like member 116 mounted adjacent one end to the frame of piecing apparatus 76', as by mounting means 120, and projecting forwardly therefrom. During movement of apparatus 76' past clearer 100, the free end portion of wand-like member 116 engages and moves across the forward face of clearer member 102. Under the impetus of the actuating force of such engagement, clearer 100 pivots to its operative position. Due to the nature of the material of which it is formed, and/or to the construction of the means 120 by which it is mounted upon apparatus 76', member 116 will laterally flex or bend to some extent as it engages each clearer 100 and/or an end-cabinet of textile machine 10, as is indicated by phantom lines in the left part of FIG. 12. However, member 116 will resiliently return to its solid-line position of FIG. 12, following each such flexure thereof, rapidly enough to sequentially engage and actuate successive ones of the clearers 100 as apparatus 76' passes proximate thereto during its repeated movement along the length of textile machine 10.

Actuating means of a non-pneumatic type might also of course be employed for actuation of the clearers 54 of the FIGS. 3–6 embodiment. For example, wand-like members of the member 116 type might be carried by conduits 22 of traveling cleaner 12 (FIGS. 1 & 6) for engagement with the forward faces of members 56 of clearers 54 during movement of clearer 12 along the length of machine 10. Sequential actuation of the clearer units of the invention might also be achieved in other ways, as for instance by magnetic or electromagnetic actuating means carried by machine 10 and/or by a servicing apparatus movable along the length of such machine.

In addition to its previously discussed first yarn-separating portion 114, the clearer 100 of FIGS. 9–12 may be and illustratively is provided with a second yarn separating portion 114' adjacent the opposite (left, as viewed in FIG. 10) end and the upper edge of its main body member 102. The provision of second yarn separating portion 114' renders cleaner 100 suitable not only for use in association with a spindle assembly rotating in a clockwise or "Z-twist" direction, as in the case of the spindle assembly 16' shown in FIGS. 10–12, but also equally suitable for use in association with a spindle assembly rotating in the opposite or "S-twist" direction. When used in association with a spindle assembly of the latter type, clearer 100 would in the same manner as previously described except that portion 114' thereof, rather than portion 114, would engage and effect separation of the length of yarn innerconnecting the underwindings and yarn package upon the assembly. In contrast to clearer 100, the clearer 54 of FIGS. 3–7 would have to be changed in construction and position for use in association with a spindle assembly rotating in the "S-twist" direction: More specifically, the modified clearer 54 would have to be mounted adjacent the opposite (left, as viewed in FIG. 3) side of the spindle assembly, and side sections 68,70 of its main body member 56 would have to occupy interchanged positions. In addition to its capability for use in association with spindle assemblies rotating in either direction, the clearer 100 of FIGS. 9–12 possesses another advantage over the clearer 54 of FIGS. 3–7. The underwindings 52 cast-off from a spindle assembly 16 with which clearer 54 is associated sometimes tend to become entangled about such clearer, due to its relatively narrow and upstanding configuration. Such problem rarely if ever arises with the clearer 100 of FIGS. 9–12. This is believed to be due to, among other possible reasons, the considerable length and flat shape of member 102 thereof. In any event the cast-off underwindings 52' do not tend to become entangled upon clearer 100, which facilitates collection and removal thereof from machine 10 following their clearance from spindle assembly 16'.

While preferred and alternative embodiments of the invention have been specifically shown and described, this was for purposes of illustration only, and not for purposes of limitation, the scope of the invention being in accordance with the following claims.

That which is claimed is:

1. In combination with a textile machine including at least one spindle rotatable about a substantially vertical axis and having lower and upper portions upon which yarn underwindings and a yarn package are respectively formed, said yarn underwindings and said yarn package being connected during package-building operation of said machine by an innerconnecting length of yarn rotatable with said spindle assembly about a path of rotary travel generally concentric with said axis of rotation of said spindle assembly; improved clearer means for, when actuated during regular package-building operation of said machine, effecting clearance of said yarn underwindings from said spindle assembly, said clearer means comprising:

a clearer unit carried by said textile machine in adjacent relationship to said spindle assembly; said clearer unit including yarn separating means movable from an inoperative position to an operative position wherein said yarn separating means intersects the path of rotary travel of said innerconnecting length of yarn about said axis of rotation of said spindle assembly; and vane-like actuator means operatively associated with said yarn separating means for moving said yarn separating means to said operative position thereof in response to the impingement of air blasts upon said actuator means.

2. The combination of claim 1, wherein said unit further includes mounting means carried by said textile machine and mounting said yarn separating means for pivotal movement, between said inoperative and operative positions thereof, about a substantially horizontally-extending pivotal axis.

3. The combination of claim 1, wherein said unit further includes stop means for limiting movement of said yarn separating beyond at least one of said positions thereof.

4. The combination of claim 1, wherein said unit further includes stop means for limiting movement of said yarn separating means beyond said inoperative and operative positions thereof.

5. The combination of claim 1, wherein said unit includes a main body member having integrally connected portions respectively comprising said yarn separating means and said vane-like actuator means; and mounting means carried by said textile machine and mounting said main body member for pivotal movement.

6. The combination of claim 5, wherein said textile machine includes a generally horizontally-extending spindle rail member and said spindle extends upwardly from said spindle rail member; and wherein said mounting means of said unit is connected to and supported upon said spindle rail member.

7. The combination of claim 6, wherein said mounting means comprises an upstanding post member fixedly connected adjacent its lower end portion to said spindle rail member and having a generally V-shaped notch within an upper portion thereof; said main body member of said unit having an edge portion received within said notch of said mounting means and being thereby mounted for said pivotal movement thereof.

8. The combination of claim 6, wherein said spindle-rail member has first and second bores extending therethrough on opposite sides of said spindle assembly; said main body member being of elongate plate-like shape and extending generally in the length direction of said spindle-rail member forwardly of said spindle assembly; said mounting means including first and second rod-like members having forward end portions fixedly connected to said main body member and having rearward end portions disposed within respective ones of said bores within said spindle rail member.

9. The combination of claim 8, wherein said yarn separating means is defined by a pointed upper edge portion of said main body member, and said actuator means is defined by a forwardly-facing surface portion of said main body member.

10. The combination of claim 1, and further including pneumatic actuating means for actuating said clearer unit by subjecting said actuator means thereof to blasts of air.

11. The combination of claim 1, wherein said spindle assembly is one of a plurality of spindle assemblies spaced along the length of said textile machine, and said clearer unit is one of a plurality of clearer units carried by said textile machine in association with respective ones of said spindle assemblies; and further including pneumatic actuating means for sequentially actuating said cleaner units by subjecting said actuator means of successive ones of said units to blasts of air.

12. Apparatus as in claim 11, and further including a mobile apparatus movable along the length direction of said textile machine, and wherein said pneumatic actuating means is carried by said mobile apparatus and actuates successive ones of said clearer units when said apparatus is in proximity thereto.

13. A method of clearing yarn underwindings from rotating spindle assemblies spaced along the length of an elongate textile machine, comprising:

providing, at fixed longitudinally-spaced locations upon the textile machine and in association with respective ones of the rotating spindle assemblies, a plurality of independently-actuable underwinding clearers each adapted when actuated to effect clearance of the yarn underwindings from an associated one of the spindle assemblies;

traversing the length direction of the textile machine by a mobile apparatus movable, while traversing the textile machine, into and out of proximity with successive ones of the underwinding clearers;

and actuating the clearers sequentially during movement of the mobile apparatus into proximity with successive ones of them.

14. The method of claim 13, wherein the step of actuating the clearers includes subjecting the same to an actuating force by actuating means carried by and movable with the mobile apparatus.

15. A method of clearing yarn underwindings from longitudinally-spaced spindle assemblies of an elongate textile machine, comprising:

providing independently-actuable clearers in association with respective ones of the spindle assemblies of the textile machine, said clearers being disposed at fixed longitudinally-spaced locations along the length of the textile machine and each of the clearers being adapted upon actuation thereof to effect clearance of yarn underwindings from an associated one of the spindle assemblies;

and actuating the clearers sequentially by moving clearer-actuating means in the length direction of the textile machine and into clearer-actuating proximity with successive longitudinally-spaced ones of the clearers.

16. In combination with an elongate textile machine including along its length a plurality of rotating spindle assemblies having yarn underwindings thereon, the improvement comprising:

clearer means for when actuated clearing the yarn underwindings from the rotating spindle assemblies; said clearer means including a plurality of independently-actuable clearer units carried by said textile machine, at fixed locations along the length thereof, adjacent respective ones of said spindle assemblies;

and actuating means movable relative to said clearer units along the length direction of said textile machine and into actuating-proximity with successive ones of said clearer units for sequentially actuating said clearer units.

17. A method of clearing rotating spindle assemblies spaced along the length of an elongate textile machine of yarn underwindings formed upon a lower portion of each of the spindle assemblies and connected by a length of yarn to a yarn package undergoing formation upon an upper portion of each of the spindle assemblies, comprising:

providing, upon the textile machine and in association with respective ones of said spindle assemblies, a plurality of underwinding clearers independently actuable by the impingement of air blasts thereon and each adapted when actuated to effect separation of the length of yarn innerconnecting the yarn underwindings and the yarn package upon the associated one of said spindle assemblies;

and actuating the clearers in sequential relationship to each other by impinging blasts of air sequentially upon successive ones of the clearers.

18. The method of claim 17, wherein the step of actuating the clearers further includes traversing the length direction of the textile machine by air-blast producing means, and discharging blasts of air from the air-blast producing means upon successive ones of the clearers when the air-blast producing means is in proximity therewith.

19. The method of claim 18, and further including continuously discharging blasts of air from the air-blast producing means as the same traverses the length direction of the textile machine.

20. A method of clearing rotating spindle assemblies spaced along the length of an elongate textile machine of yarn underwindings formed upon a lower portion of each of the spindle assemblies and connected by a length of yarn to a yarn package undergoing formation upon an upper portion of each of the spindle assemblies, comprising:

providing, at longitudinally-spaced fixed locations upon the textile machine adjacent respective ones of said spindle assemblies, a plurality of independently-actuable underwinding clearers each adapted when actuated to effect separation of the length of yarn innerconnecting the yarn underwindings and the yarn package upon the adjacent one of said spindle assemblies;

traversing the length direction of the textile machine by a mobile apparatus having clearer actuating means movable therewith;

and actuating the clearers, in sequential relationship to each other, when the mobile apparatus moves into proximity with successive ones of them.

21. The method of claim 20, wherein the actuating means comprises a wand-like member, and the clearers are actuated by engagement of the wand-like member therewith.

22. A method of clearing rotating spindle assemblies spaced along the length of an elongate textile machine of yarn underwindings formed upon a lower portion of each of the spindle assemblies and connected by a length of yarn to a yarn package undergoing formation upon an upper portion of each of the spindle assemblies, comprising:

providing, upon the textile machine and in association with respective ones of said spindle assemblies, a plurality of underwinding clearers actuable independently of each other by the impingement of blasts of air thereon and each adapted when actuated to effect separation of the length of yarn innerconnecting the yarn underwindings and the yarn package upon the associated one of said spindle assemblies;

traversing the length direction of the textile machine by a mobile apparatus having air-blast producing means movable therewith for actuating the clearers;

and actuating the clearers, in sequential relationship to each other and by the impingement thereon of blasts of air from the air-blast producing means, when the mobile apparatus moves into proximity with successive ones of the clearers.

23. A method of clearing yarn underwindings from rotating spindle assemblies spaced along the length of an elongate textile machine, comprising:

providing, upon the textile machine and in association with respective ones of the rotating spindle assemblies, a plurality of underwinding clearers actuable pneumatically and independently of each other by the impingement of blasts of air thereon and each adapted when actuated to effect clearance of the yarn underwindings from an associated one of the spindle assemblies;

traversing the length direction of the textile machine by a mobile apparatus;

and actuating the clearers sequentially, during movement of the mobile apparatus into proximity with successive ones of them, by subjecting the clearers to actuating blasts of air emanating from the mobile apparatus.

24. A method of clearing yarn underwindings from rotating spindle assemblies spaced along the length of an elongate textile machine, comprising:

providing, upon the textile machine and in association with respective ones of the rotating spindle assemblies, a plurality of underwinding clearers pneumatically and independently actuable by the impingement of blasts of air thereon and each adapted when actuated to effect clearance of the yarn underwindings from an associated one of the spindle assemblies;

traversing the length direction of the textile machine by a traveling pneumatic cleaner continuously producing clearer actuating blasts of air during its movement along the length of the textile machine;

and actuating the clearers sequentially during movement of the traveling pneumatic cleaner into proximity with successive ones of them.

* * * * *

UNITED STATES PATENT AND TRADEMARK OFFICE

CERTIFICATE OF CORRECTION

PATENT NO. : 4,208,865

DATED : 24 June 1980

INVENTOR(S) : Ernest Koella III

It is certified that error appears in the above-identified patent and that said Letters Patent are hereby corrected as shown below:

Col. 6, line 39, "which" should read --while--. Col. 8, line 60, "attentua-" should read --attenua- --. Col. 9, line 64, "transversly" should read --transversely--. Col. 10, line 34, "tuite" should read --tuate--; line 47, "then being passing" should read --then passing--. Col. 12, line 26, "they shown" should read --they are shown--. Col. 13, line 37, "member" should read --members--. Col. 14, line 24, "cleaner" should read --clearer--. Col. 15, line 45 (line 2 of claim 1), "spindle rotatable" should read --spindle assembly rotatable--. Col. 16, line 26 (line 3 of claim 6), "spindle extends" should read --spindle assembly extends--; line 65 (line 8 of claim 11), "cleaner" should read --clearer--.

Signed and Sealed this

*Thirtieth* Day of *September 1980*

[SEAL]

*Attest:*

SIDNEY A. DIAMOND

*Attesting Officer*

*Commissioner of Patents and Trademark*